US005531057A

United States Patent [19]

Coleman et al.

[11] Patent Number: 5,531,057

[45] Date of Patent: Jul. 2, 1996

[54] BOTTLE CAP DELIVERY SYSTEM

[75] Inventors: Matthew R. Coleman, Pottstown; Gerald M. Futej, West Chester; James D. Ash, Pottstown, all of Pa.

[73] Assignee: Crown Cork and Seal Company, Inc., Philadelphia, Pa.

[21] Appl. No.: 525,224

[22] Filed: Sep. 8, 1995

[51] Int. Cl.[6] ..... B67B 3/06; B67B 3/064; B65B 7/28

[52] U.S. Cl. ..... 53/308; 53/306

[58] Field of Search ..... 53/306, 308, 311, 53/312, 389.1

[56] References Cited

U.S. PATENT DOCUMENTS

| | | | |
|---|---|---|---|
| 3,643,398 | 2/1972 | Quest et al. | 53/306 X |
| 3,683,588 | 8/1972 | Ahlers | 53/308 X |
| 3,820,305 | 6/1974 | Van Der Meer | 53/308 |
| 5,280,693 | 1/1994 | Heudecker | 53/306 |
| 5,309,696 | 5/1994 | Heudecker et al. | 53/308 X |

*Primary Examiner*—Horace M. Culver
*Attorney, Agent, or Firm*—Howard & Howard

[57] ABSTRACT

A bottle-cap positioning apparatus (10) positions bottle-caps (12) beneath the orbiting capping heads (14) of a rotary bottle-capping machine (18) for pick-up. A cap feeder (40) places the caps (12) on a semi-circular pick-up path directly under the orbital path (16) of the capping heads (14). An endless belt (68) is supported on a pair of pulleys (52, 54) and orbits around a guide block (76). The guide block (76) has a convex surface (78) that pushes the belt (68) outward to parallel the pick-up path. Cap push-paddles (80) extend radially out from the endless belt (68) and slide the bottle caps (12) sequentially along the pick-up path. Gears (58, 62, 64, 66) drive the pulleys (52, 54) and synchronize the endless belt (68) with the capping heads (14). The endless belt (68), push-paddles (80), pulleys (52, 54) and gears (58, 62, 64, 66) are disposed inside and beneath the orbital path of the capping heads (14) to reduce factory floor space requirements and worker exposure to moving parts.

45 Claims, 7 Drawing Sheets

A
18
24
24
36
26
22
24
24
3
3
60
32
56
14
10
42
62
64
30
38
14
34
12
66
80
52
68
75
58
80
12
90
42
40
20

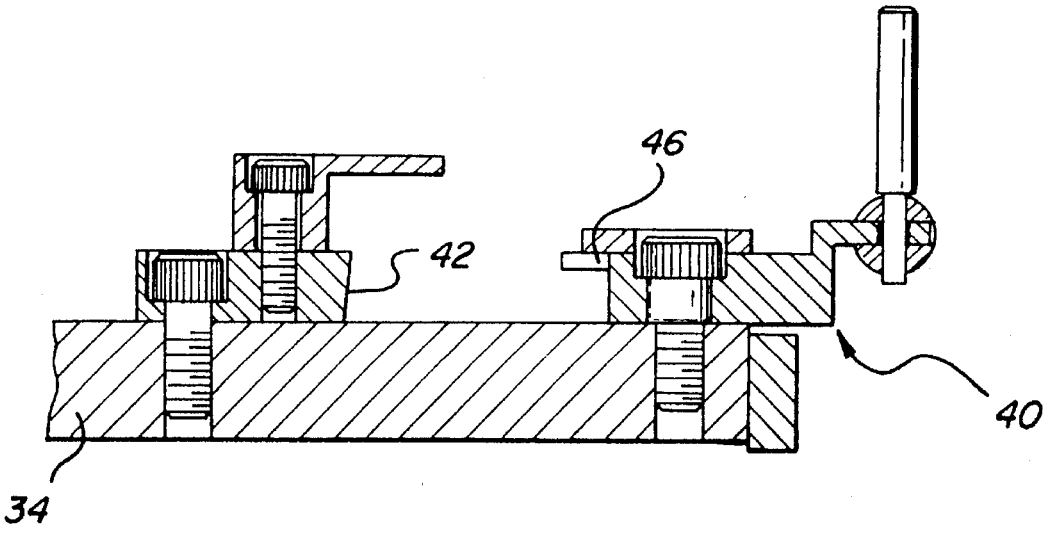
FIG-6
FIG-7
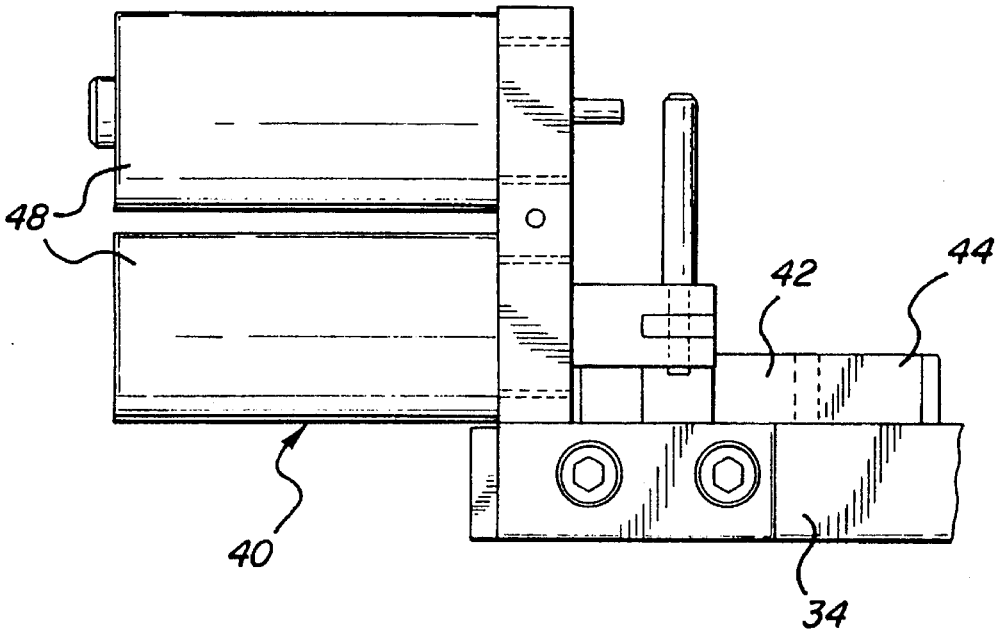

BOTTLE CAP DELIVERY SYSTEM

TECHNICAL FIELD

This invention relates to a bottle cap delivery apparatus.

BACKGROUND OF THE INVENTION

Rotary bottle capping machines typically receive bottles from an in-coming conveyor belt, screw caps on the bottles, then transfer the bottles to an out-going conveyor belt. Bottle capping machines of this type normally include capping heads that orbit rapidly around a pitch circle picking-up bottle caps and screwing them to bottles. These machines require high-speed bottle cap delivery systems that can accurately, rapidly and consistently position bottle caps where the capping heads can pick them up.

This has been accomplished with the so-called "pick and place" cap delivery systems in which caps are transported to a discrete position along the capping head pitch circle, which position constitutes a discrete pick-up point. However, it is difficult and expensive to design capping heads that can consistently and rapidly receive caps when the capping heads and caps are both positioned at the discrete pick-up point for only an instant. With a dwell time that is practically instantaneous, there is very little room for error when a capping head descends to pick up a cap. There is no time for the capping heads or cap delivery system to compensate for imperfections in the dynamic process. To overcome this problem, more advanced bottle cap positioning systems increase capping head dwell time by introducing bottle caps into rotary capping machines along a semi-circular pick-up path. A semi-circular pick-up path gives each capping head more time to receive each cap.

To rapidly introduce bottle caps into a rotary bottle-capping machine along a semi-circular pick-up path, bottle cap positioners typically use endless belts to carry the caps along the pick-up path. Bottle cap positioners that use endless belts must be located where the endless belt can receive bottle caps from a cap supply source and deliver the caps to the bottle capping machine.

Current bottle cap positioners cannot be fully integrated into bottle capping machines because their endless belts must run outside the capping machine's capping-head pitch-circle. These "non-integrated" endless belts include individual cap holders that pick up and carry each bottle cap to the capping machine from a remote supply location or feeder apparatus. The cap holders transport each cap across the distance between the remote supply location and the rotary capping machine, then carry it along a semi-circular pick-up path beneath the capping head pitch circle for pick-up by capping heads. The belts then carry each empty cap holder back outside the capping machine to the remote feeder apparatus for a "refill". Belts of this type, that must run outside the capping machine, require additional factory floor space, expose workers to high-speed moving parts, and are susceptible to contamination by external substances and jamming by external objects.

For example, U.S. Pat. No. 3,820,305 to Van Der Meer, issued Jun. 28, 1974, discloses a bottle-cap positioning apparatus for positioning bottle-caps for pick-up by capping-heads orbiting along a capping-head pitch circle within a rotary bottle-capping machine. A cap conveyor is supported on a base plate to sequentially move bottle caps along a semi-circular pick-up path. The cap conveyor includes an endless belt in the form of a chain supported on the base plate to orbit in place abut a belt centroid. A guide block with a convex surface in the form of a guiding edge is disposed adjacent and parallel to the semi-circular pick-up path to guide the chain into a semi-circular curve adjacent and parallel to the semi-circular pick-up path. But the endless chain cannot be disposed to orbit entirely within the capping head pitch circle; it must exit the pitch circle to retrieve bottle caps from a remote cap feeder in the form of a supply trough.

SUMMARY OF THE INVENTION AND ADVANTAGES

A bottle-capping apparatus is provided for applying screw-type closures to the threaded neck portion of a bottle. The apparatus comprises a base, a turret rotatably supported above the base about a central vertical axis, a plurality of capping-heads independently rotatably and reciprocally supported from the turret about respective vertical axes. The respective vertical axes are equally spaced along a common pitch circle concentric with the central axis. A cap conveyor means is provided for sequentially delivering bottle-caps to each of the capping-heads. The improvement of the invention resides in the cap conveyor means including a driven endless belt which is disposed entirely within the circumscribed boundaries of the pitch circle to reduce space requirements and worker exposure to the endless belt.

According to a second aspect of the invention, a bottle-cap delivery apparatus is provided for positioning bottle-caps for pick-up by capping-heads orbiting along a capping-head pitch circle within a rotary bottle-capping machine. A cap conveyor means is supported on a base plate for sequentially moving bottle caps along a semi-circular pick-up path. The cap conveyor means includes an endless belt with a belt inner surface supported on the base plate to orbit in place about an imaginary belt centroid. A convex surface is disposed adjacent and parallel to the semi-circular pick-up path for guiding the belt into a semi-circular curve adjacent and parallel to the semi-circular pick-up path. The invention is characterized by the disposition of the convex surface adjacent the belt inner surface to displace the belt and the semi-circular pick-up path outward and away from the belt centroid to locate the belt centroid and the belt inside the pitch circle of a rotary bottle-capping machine.

The endless belt location inside the capping head pitch circle has several advantages. With most rotary capping machines, the capping heads and other moving parts are enclosed within or beneath a protective shroud or cover. Because the endless belt is located inside the pitch circle and inside or beneath the shroud, it is well-protected from external interferences such as jamming or contamination that could impede its function or dislodge caps. With the endless belt enclosed completely inside the shroud, capping machine operators are better protected from inadvertent entanglement with the belt. In addition, because the belt does not extend outside the rotary capping machine, it does not require additional factory floor space and does not require other external components or machinery to be routed alongside.

BRIEF DESCRIPTION OF THE DRAWINGS

Other advantages of the present invention will be readily appreciated as the same becomes better understood by reference to the following detailed description when considered in connection with the accompanying drawings wherein:

FIG. 6 is a cross-sectional view of the cap feeder taken along line 6—6 of FIG. 3;

FIG. 7 is a side view of the dual solenoid assembly; and

DETAILED DESCRIPTION OF THE PREFERRED EMBODIMENT

Figure 1:
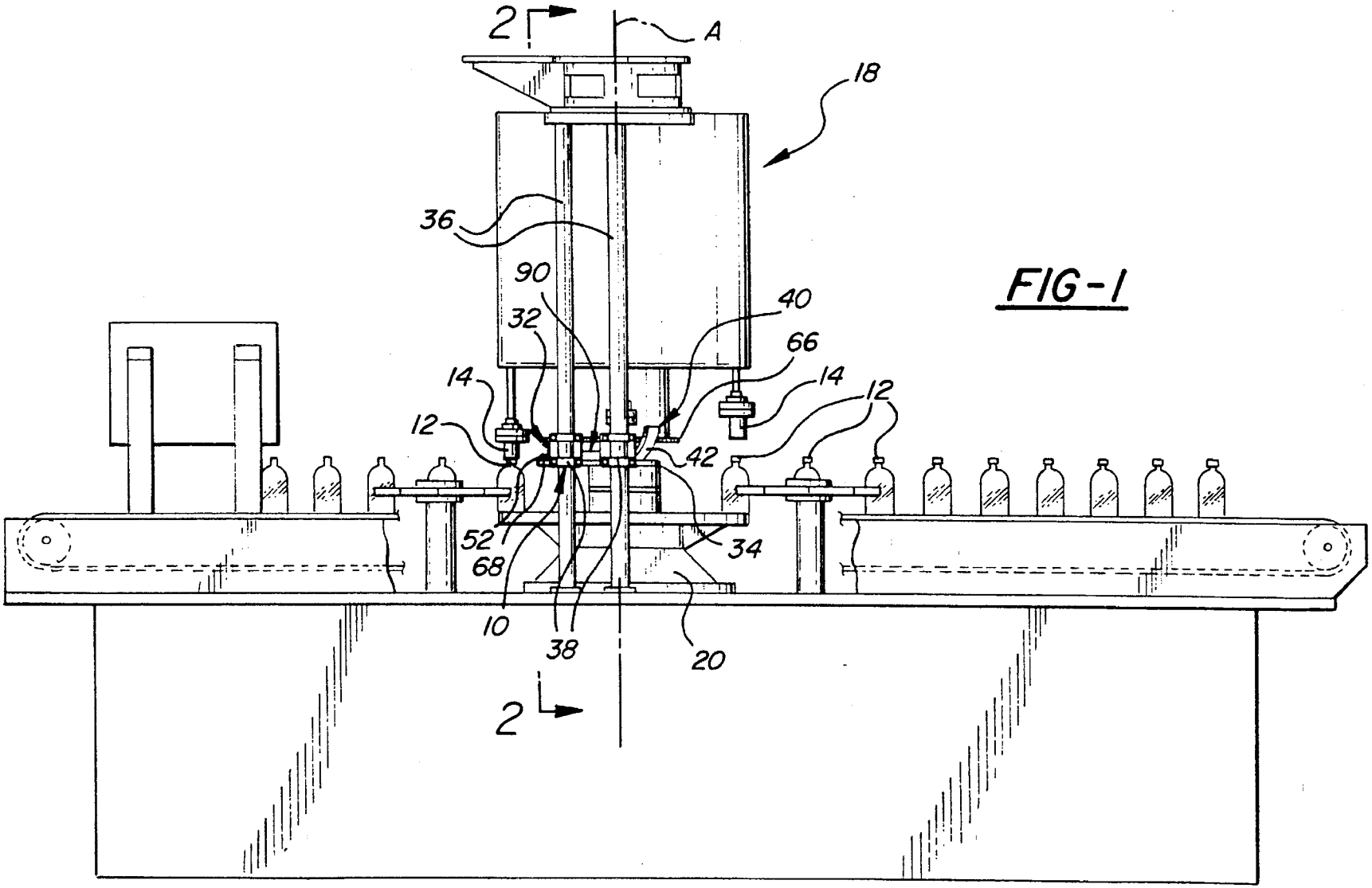
FIG. 1 is a front elevation view of a bottle-capping apparatus installed for operation, in a bottle capping assembly line.
Figure 2:
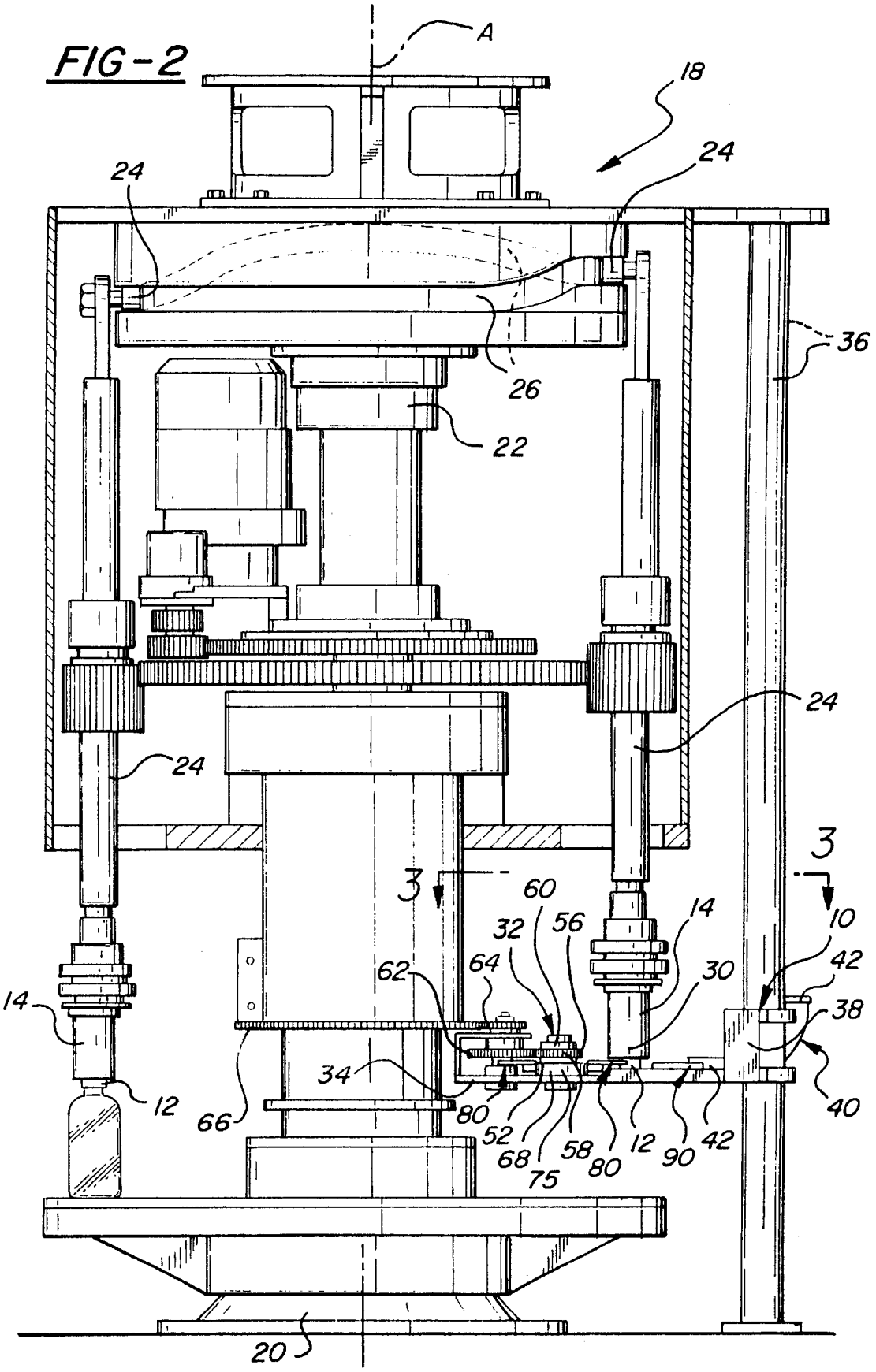
FIG. 2 is a partial cross-sectional view of a bottle-capping apparatus taken along lines 2—2 of FIG. 1.
Figure 3:
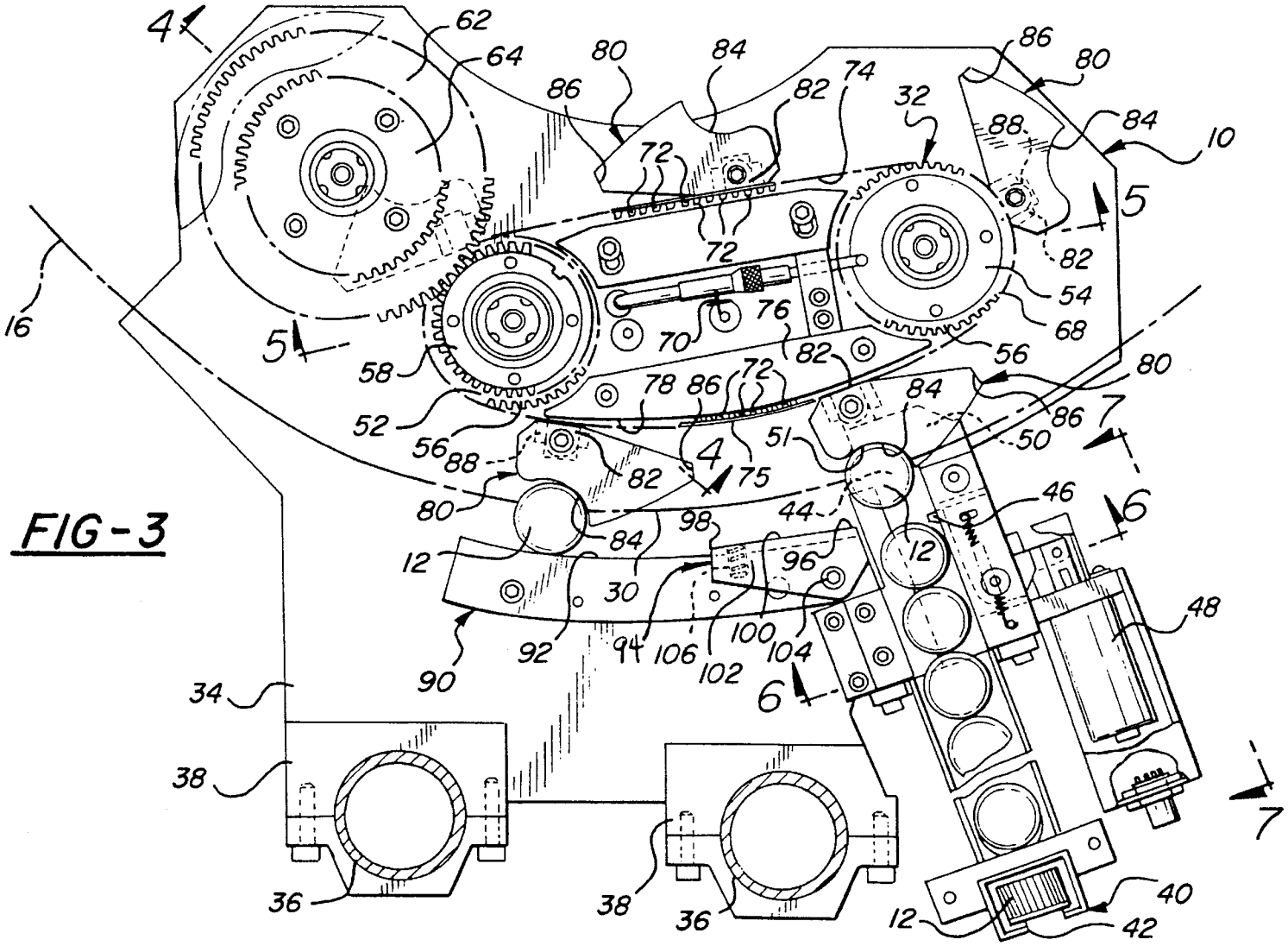
FIG. 3 is a partial cross-sectional view of the bottle-cap delivery apparatus taken along lines 3—3 of FIG. 2.
Figure 4:
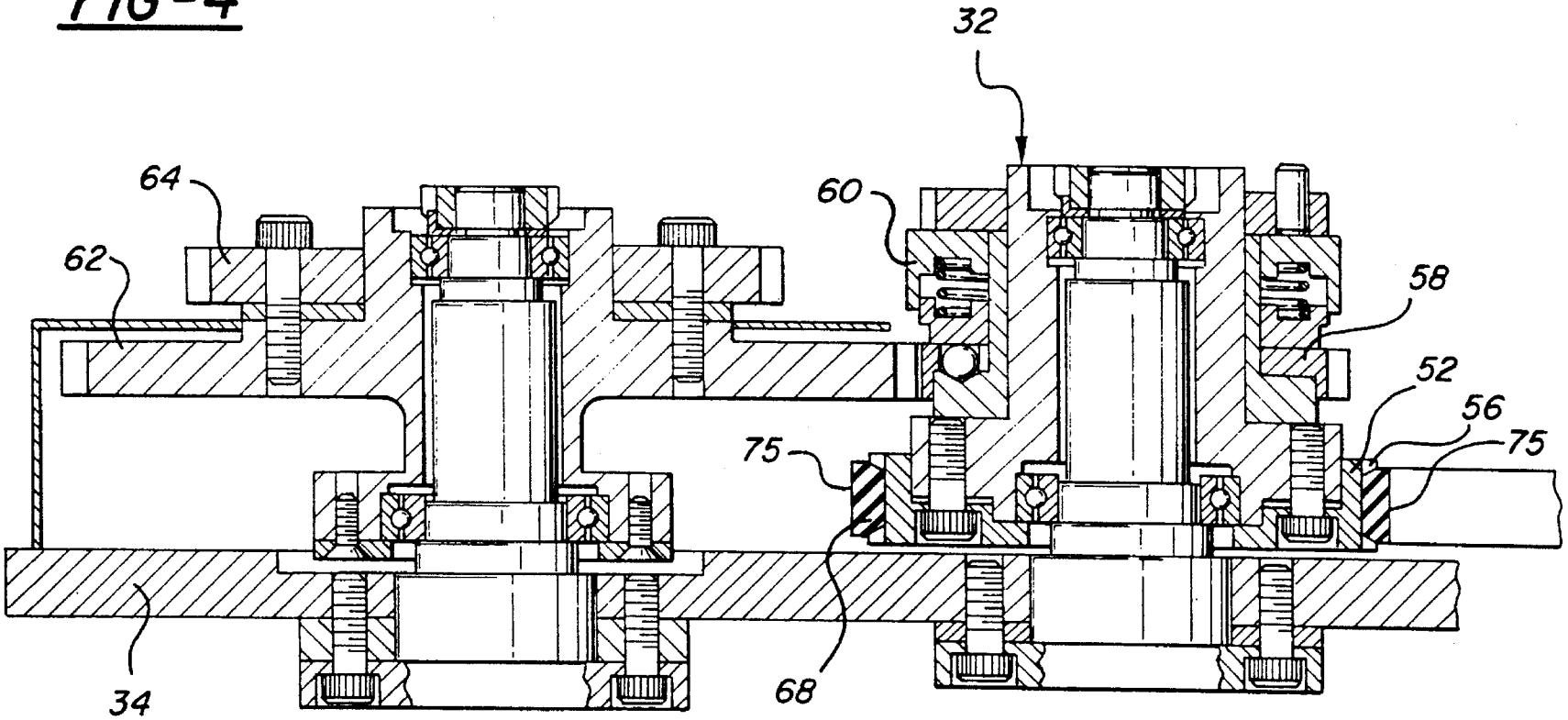
FIG. 4 is a cross-sectional view taken along line 4—4 of FIG. 3.
Figure 5:
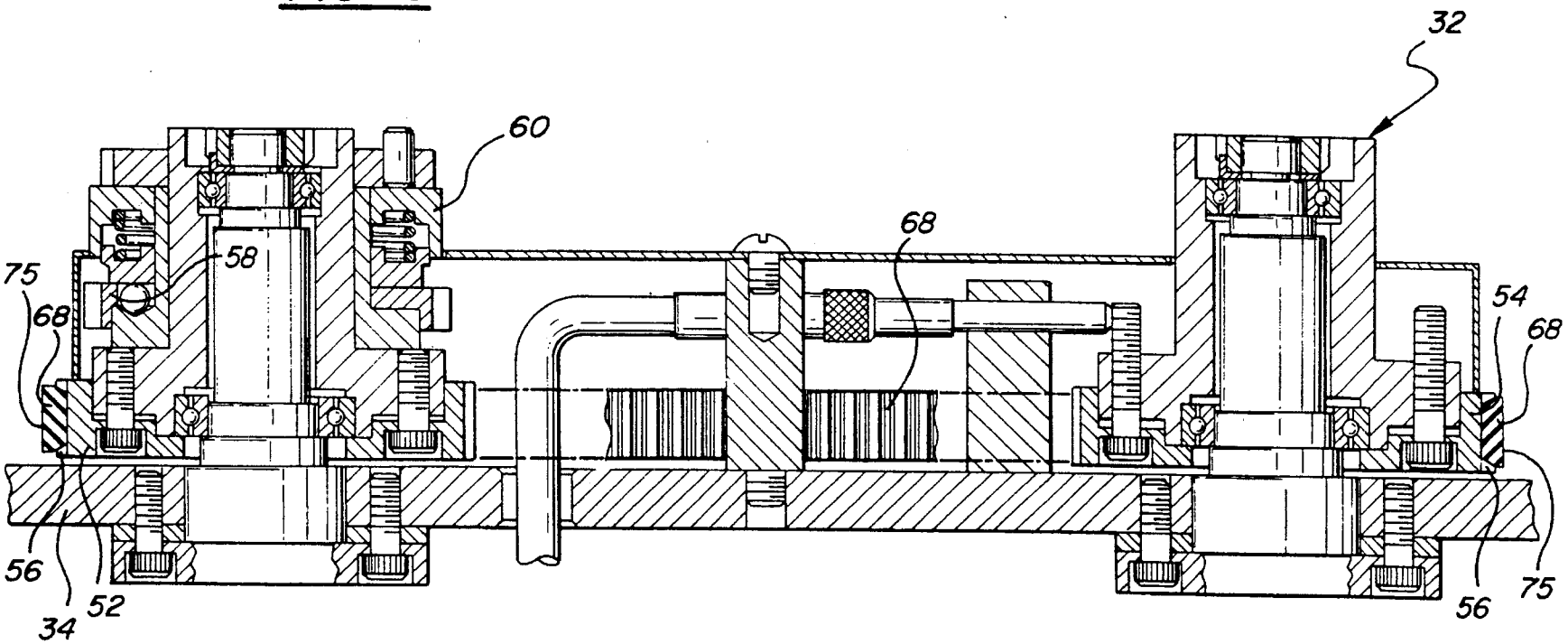
FIG. 5 is a cross-sectional view taken along line 5—5 of FIG. 3.

A bottle-cap delivery apparatus is generally indicated at 10 in FIGS. 1, 2 and 3. The bottle-cap positioning apparatus 10 positions bottle-caps 12 for pick-up by capping-heads 14 orbiting along a capping-head pitch circle 16 within a rotary bottle-capping apparatus, generally shown at 18 in FIGS. 1 and 2.

The bottle-capping apparatus 18 includes a base 20, generally cylindrical in shape, and disposed on a flat surface such as a floor or table. A turret, best shown at 22 in FIG. 2, is also generally cylindrical in shape and is rotatably supported above the base 20 about a central vertical axis A.

The capping-heads 14 are independently rotatably and reciprocally supported from the turret 22 along respective vertical axes. Each capping-head 14 is connected to the bottom of an elongated shaft 24 that extends down from the turret 22 and is attached, at its upper end, to a roller 24 that rides up and down in a cam track 26.

The capping-heads 14 and their elongated shafts 24 move horizontally along a common pitch circle 16 about the central axis A. The pitch circle 16 is disposed at an elevation equal to that of the capping heads 14 when supported from the highest point in the cam track 26. The pitch circle 16 has a pitch circle radius measured from the central axis A radially outward to any one of the respective vertical axes of the capping-heads 14.

A semi-circular pick up path, shown in FIG. 3, is disposed directly beneath a pick-up portion 30 of the pitch circle 16. The semi-circular pick-up path is concentric with the pitch circle 16 about the central axis A and has a pick-up path radius equal to the pitch circle 16 radius. As the capping-heads 14 move along the pick-up portion 30 of the pitch circle 16 they descend while following the semi-circular pick-up path. The capping-heads 14 descend at this point to pick up bottle-caps 12 as the caps 12 travel along the semi-circular pick-up path.

A cap conveyor means, generally indicated at 32 in FIGS. 1, 2, 3, 4, 5 and 8, sequentially delivers bottle-caps 12 to each of the capping-heads 14. The cap conveyor means 32 is supported on a base plate 34 and moves the bottle-caps 12 sequentially along the semi-circular pick-up path with each cap 12 positioned directly beneath one of the orbiting capping-heads 14.

An external support positions the base plate 34 beneath the pick-up portion 30 of the pitch circle 16 in the bottle-capping apparatus 18. The semi-circular pick-up path is disposed on an upper surface of the base plate 34 directly beneath the pick-up portion 30 of the pitch circle 16. The external support comprises two vertical mounting bars, shown at 36 in FIGS. 1, 2, 3 and 8. A pair of mounting brackets 38 extend integrally from the base plate 34 and are adapted to surround and clamp to the vertical mounting bars 36. The base plate 34, base plate mounting brackets 38 and vertical mounting bars 36 are made of metal.

A cap feeder, generally indicated at 40 in FIGS. 1, 2, 3, 6, 7 and 8, is supported on the base plate 34. The cap feeder 40 feeds bottle-caps 12 from an external supply to the semi-circular pick-up path in the rotary bottle-capping apparatus 18.

The cap feeder 40 includes a cap chute 42 that intersects and delivers bottle-caps 12 to the semi-circular pick-up path. The cap chute 42 includes a metal channel that extends outwardly and upwardly from the semi-circular pick-up path. The metal channel has a generally rectangular cross section and is large enough to permit bottle-caps 12 to slide, single-file, down its length from a cap supply source. At the lower end of the cap chute 42 is an exit 44 extending into the semi-circular pick-up path.

The cap feeder 40 includes a cap feed latch, indicated at 46 in FIGS. 3 and 6, that retractably extends into the cap chute 42 adjacent the exit 44. The latch 46 includes a metal finger that extends into the cap chute 42 to block bottle-caps 12 from descending down the chute 42 to the exit 44. The finger reciprocates, extending into and retracting out of the chute 42 to allow bottle-caps 12 to slide, out onto the pick-up path.

The cap feeder 40 includes a dual solenoid, indicated at 48 in FIGS. 3 and 7, operatively connected to the cap feed latch 46. The dual solenoid 48 includes a first solenoid for extending the cap feed latch 46, and a second solenoid for retracting it. The second solenoid acts in alternating opposition to the first solenoid and responds faster and more positively than would a single solenoid with a spring-return. The dual solenoid 48 is less likely to double-feed or jam bottle-caps 12 in the cap chute 42. It is also less likely to strike glancing blows to passing bottle-caps 12 that might cause the caps 12 to fly out of control.

The cap feeder 40 includes a cap retainer, indicated at 50 in FIG. 3, disposed at the exit 44 end of the cap chute 42 on the semi-circular pick-up path. The retainer 50 is a flat hook-shaped member with its hook shape defined by an approximate 100 degree semi-circular retaining wall 51. The retaining wall 51 has a radius slightly greater than that of the caps 12 it retains. The hook-shaped retaining wall 51 opens toward the cap chute 42 and the pick-up path. The retaining wall 51 is shaped to receive and hold bottle-caps 12 as they pass out from the cap chute 42, but allows them to be swept out of the retainer 50 and along the semi-circular pick-up path.

Turning to FIG. 3, the cap conveyor means 32 includes at least two pulleys 52, 54 rotatably mounted adjacent and above the base plate 34 on respective vertical rotational axes. One of the pulleys 52, 54 is a drive pulley 52 and the other is a driven pulley 54. Both pulleys 52, 54 include radially-extending pulley teeth 56.

The cap conveyor means 32 includes a gear assembly that operatively connects the pulleys 52, 54 to the turret 22. The gear assembly also synchronizes the rate at which caps 12 are advanced along the semi-circular pick-up path with the orbital velocity of the capping-heads 14.

The gear assembly includes a drive gear 58. The drive gear 58 is a spur gear with a vertical rotational axis and is supported for rotation coaxially adjacent and above the drive pulley 52.

The gear assembly also includes a clutch 60 disposed between the drive pulley 52 and the drive gear 58. When engaged, the clutch 60 operatively connects the drive pulley 52 to the drive gear 58 causing them to rotate at the same rate about their common vertical axis. The clutch 60 is a ball/detent type clutch 60 and allows the pulleys 52, 54 to stop rotating by disengaging the drive pulley 52 from the drive gear 58 in case of a jam.

The gear assembly includes an idler gear rotatably supported on the base plate 34 and including a lower idler gear 62 operatively intermeshed with the drive gear 58. The idler gear includes an upper idler gear 64 fixed coaxially to the lower idler gear 62. The upper 64 and lower 62 idler gears are spur gears with a common vertical rotational axis.

A sun gear 66 is supported on the turret 22 for rotation about the axis A and operatively intermeshes with the upper idler gear 64. The sun gear 66 is a spur gear and is fixed to and turns at the same rate as the turret 22. The sun gear 66 drives the upper idler gear 64 which causes the larger coaxial lower idler gear 62 to turn. The lower idler gear 62 intermeshes with the drive gear 58 and causes it to turn. When the clutch 60 is engaged, the drive gear 58 causes the drive pulley 52 to turn.

The pulleys 52, 54, drive gear 58, idler gears 62, 64 and sun gear 66 are designed to synchronize the orbital velocity of the capping-heads 14 with the rate at which caps 12 are advanced along the semi-circular pick-up path. Obviously, the diametrical ratios between various gear pairs may be altered so long as the velocities of the capping-heads 14 and the bottle-caps 12 remain the same. In addition, toothed belts or simple belt and pulley arrangements could be substituted for the intermeshing gears of the preferred embodiment. The pulleys 52, 54, drive gear 58, lower idler gear 62, upper idler gear 64 and sun gear 66 are made, alternately, of a high-strength non-metallic material (such as nylon) and gear quality metal. In this manner, there is no metal-to-metal contact between the gears, thus eliminating the need for lubrication.

The cap conveyor means 32 includes an endless belt 68 supported on the base plate 34 to orbit in place about an imaginary belt centroid, indicated at 70 in FIG. 3. A centroid is a point in space representing the center of gravity of a homogeneous mass or volume. Here, the belt centroid 70 is defined as a point in space coincident with the center of gravity of the endless belt 68, assuming that the endless belt 68 is homogeneous.

The endless belt 68 is supported over and extends between the pulleys 52, 54 forming a generally elliptical belt track around and between the drive pulley 52 and the driven pulley 54. The endless belt 68 includes belt teeth 72. The endless belt has belt inner 74 and outer 75 surfaces and the belt teeth 72 are vertically oriented around the belt inner surface 74 and extend radially inward to engage the radially-outward extending pulley teeth 56. The intermeshing belt 72 and pulley teeth 56 preclude slippage between the pulleys 52, 54 and the belt 68. The belt 68 is a band of elastomeric polymeric material such as rubber, but could also be a linked chain or a cord.

The cap conveyor means 32 includes a guide block, indicated at 76 in FIG. 3, disposed in the space between the pulleys 52, 54 and inside the loop formed by the endless belt 68. A convex surface 78 is disposed on the guide block 76 adjacent and parallel to the semi-circular pick-up path. The guide block convex surface 78 is disposed adjacent and presses against the inner surface 74 of the belt 68 and displaces the belt 68 outward and away from the belt centroid 70 to define the semi-circular pick-up path.

Figure 8:
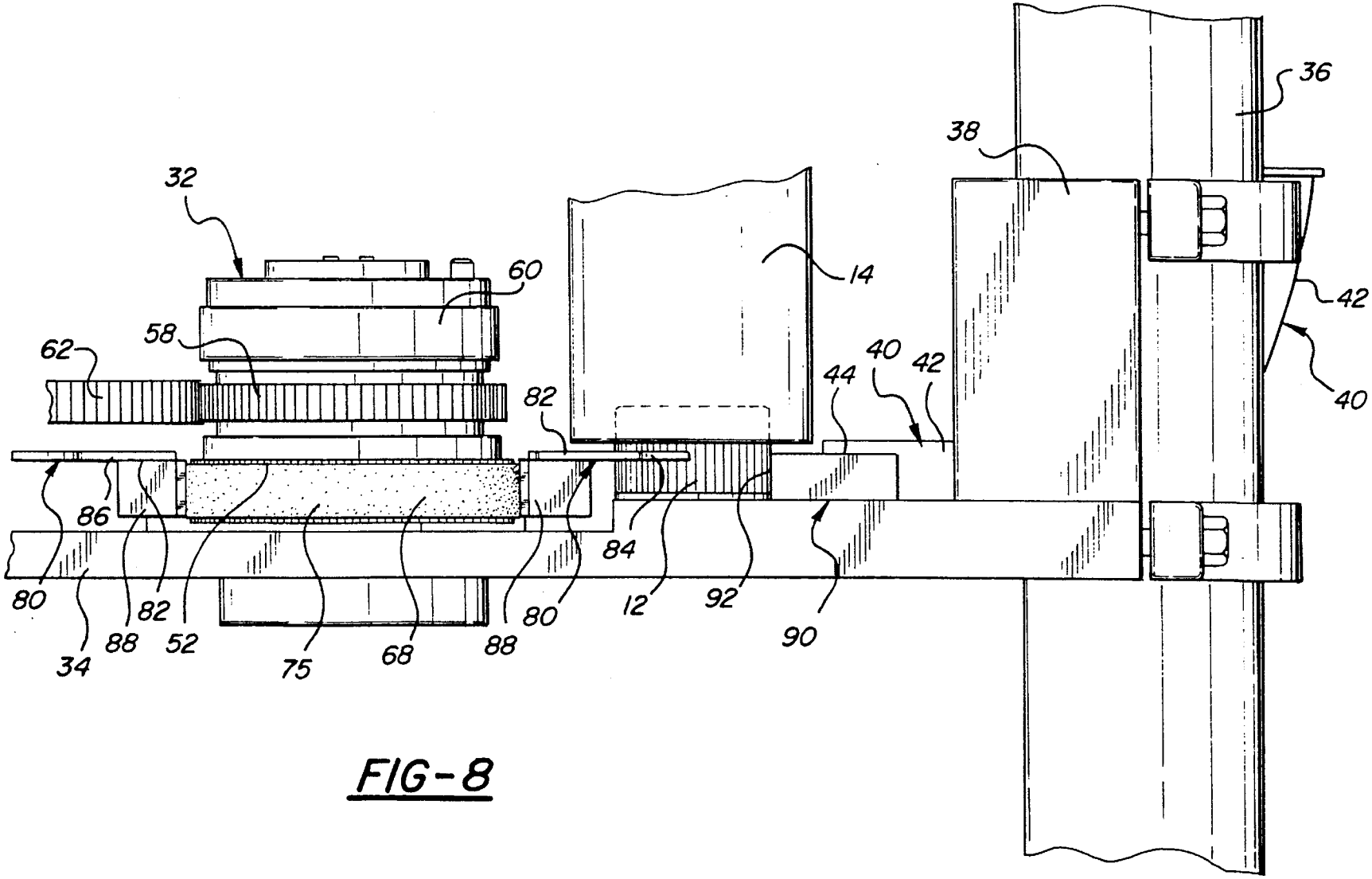
FIG. 8 is a fragmentary view of the bottle-cap delivery apparatus showing a capping head receiving a bottle cap.

A plurality of push-paddles, generally indicated at 80 in FIGS. 2, 3 and 8, extend from and are spaced around the outer surface 75 of the endless belt 68. The push-paddles 80 comprise thin plates stamped or cut into a shape approximating a profile-view of a shoe with an attachment point 82 at the "heel" portion, a cap-seat 84 at the "foothole", and a tail section 86 at the "toe", as is best shown in FIG. 3. The flat shoe-shaped push-paddles 80 extend radially outward from the endless belt 68. At each attachment point 82, each push-paddle 80 is pivotally attached to a fixture 88 extending laterally outward from the outer surface 75 of the belt 68. The back of the heel portion of each push-paddle 80 points in the direction the push-paddles 80 travel around the belt centroid. The tail section 86, or "toe", of each push-paddle 80 points backwards, away from the direction of push-paddle 80 travel.

Each push-paddle 80 includes a cap-seat 84 located at the outer leading corner of each push-paddle 80. The cap-seat 84 is an arcuate cutaway section with a radius approximating that of the bottle-caps 12. The cap-seat 84 is the portion of each push-paddle 80 that actually contacts the bottle-caps 12, removing them from the retainer 50 at the base of the cap chute 42 and sliding them, one at a time, along the semi-circular pick-up path.

The cap retainer 50 at the cap chute exit 44 has a height greater than approximately half that of the bottle-caps it processes. The push-paddles 80 are attached to the endless belt 68 at a height that allows them to pass under the retainer 50 and engage and sweep the bottle-caps 12 down the pickup path. The push-paddles 80 contact each bottle-cap 12 at a point approximately half way up its height.

The cap conveyor means 32 includes a guide rail, generally indicated at 90 in FIGS. 1, 2, 3 and 8, disposed opposite the guide block convex surface 78 and adjacent the semi-circular pick-up path. The guide rail 90 is bolted onto the top surface of the base plate 34 and rises to a height approximately half that of the bottle-caps 12 it processes. The guide rail 90 includes a concave surface 92 spaced a constant distance across the semi-circular pick-up path from the guide block convex surface 78.

A brake, generally indicated at 94 in FIG. 3, is pivotally mounted to the guide rail 90, and extends from the concave surface 92 a short distance out into the semi-circular pick-up path. The brake 94 includes a vertical face plate with a leading edge 96, a trailing edge 98 and a top edge 100. The brake 94 also includes a generally triangular horizontal top plate 102 integrally joined to the vertical face plate along the top edge 100. The top plate 102 has a vertical pin hole through which a pin or pivot bolt 104 passes to pivotally secure the brake 94 to a pin-receiving hole in the guide rail 90.

The brake 94 includes a compression spring 106 disposed between the guide rail 90 and the brake 94 at a point adjacent the brake trailing edge 98. The spring 106 biases the trailing edge 98 of the brake 94 pivotally outward into the pickup path. The outwardly-biased brake 94 acts to dampen the motion of bottle-caps 12 as they are struck by the push-paddles 80 and propelled along the pick-up path. In other words, the brake 94 squeezes each cap lightly against a push-paddle cap-seat 84 preventing each cap 12 from rebounding when it is first struck by a push-paddle 80 and propelled out of the cap retainer 50.

The bottle-cap positioning apparatus 10 positions the endless belt 68 entirely within the lateral limits of the pitch circle 16. In other words, no part of the endless belt 68 extends beyond an imaginary cylindrical boundary described by moving a vertical line around the capping-head pitch circle 16. Because the belt 68 does not extend out of the bottle-capping apparatus 18, it requires no additional factory floor space to support its operation and can be more easily incorporated into a bottle-filling and processing line. Because the belt 68 is entirely enclosed within the rotary capping machine 18, workers are exposed to no additional hazard from moving machinery. In addition, the belt 68, the push-paddles 80, and the pulleys 52, 54 and gears that drive them are protected from external interference.

The endless belt 68 may be positioned within the pitch circle 16 because the guide block convex surface 78 is disposed between the pulleys 52, 54 and adjacent the belt inner surface 74. In this position the convex surface 78 displaces the belt 68 and the semi-circular pick-up path outward and away from the belt centroid 70. With the endless belt 68 and semi-circular pick-up path displaced outward, the belt centroid 70 and the belt 68 may be located inside the pitch circle 16 of a rotary bottle-capping apparatus 18.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A bottle-capping apparatus (18) for applying screw-type cap closures to the threaded neck portion of a bottle, said apparatus comprising:

a base (20);

a turret (22) rotatably supported above said base (20) about a central vertical axis (A);

a plurality of capping-heads (14) independently rotatably and reciprocally supported from said turret (22) about respective vertical axes, said respective vertical axes equally spaced along a common pitch circle (16) concentric with said central axis (A);

cap conveyor means (32) for sequentially delivering bottle-caps (12) to each of said capping-heads (14);

characterized by said cap conveyor means (32) including a driven endless belt (68) disposed entirely within the circumscribed boundaries of said pitch circle (16) to reduce space requirements and worker exposure to said endless belt (68).

2. A bottle-capping apparatus (18) as set forth in claim 1, including a base plate (34) supporting said cap conveyor means (32).

3. A bottle-capping apparatus (18) as set forth in claim 2, wherein said endless belt (68) is supported on said base plate (34) to orbit in place about a belt centroid (70).

4. A bottle-capping apparatus (18) as set forth in claim 3, wherein said endless belt (68) includes a belt inner surface (74) and where said cap conveyor means (32) includes a convex surface (78) disposed adjacent said belt inner surface (74).

5. A bottle-capping apparatus (18) as set forth in claim 4, wherein said convex surface (78) displaces said belt (68) outward and away from said belt centroid (70) defining a semi-circular pick-up path.

6. A bottle-capping apparatus (18) as set forth in claim 5, wherein said pitch circle (16) has a pitch circle radius and where said semi-circular pick-up path has a pick-up path radius substantially equal to said pitch circle radius.

7. A bottle-capping apparatus (18) as set forth in claim 6, wherein said pitch circle (16) has a pick-up portion (30) and where said semi-circular pick-up path lies adjacent and parallel said pick-up portion (30) of said pitch circle (16).

8. A bottle-capping apparatus (18) as set forth in claim 2, including an external support connected to and supporting said base plate (34).

9. A bottle-capping apparatus (18) as set forth in claim 8, wherein said external support comprises two vertical mounting bars (36).

10. A bottle-capping apparatus (18) as set forth in claim 9, including mounting brackets (38) integrally extending from said base plate (34).

11. A bottle-capping apparatus (18) as set forth in claim 10, wherein said base plate mounting brackets (38) are connected to said vertical mounting bars (36).

12. A bottle-capping apparatus (18) as set forth in claim 11, wherein said base plate (34), base plate mounting brackets (38) and vertical mounting bars (36) are made of metal.

13. A bottle-capping apparatus (18) as set forth in claim 2, wherein said cap conveyor means (32) includes at least two pulleys (52, 54) rotatably mounted above said base plate (34).

14. A bottle-capping apparatus (18) as set forth in claim 13, wherein said endless belt (68) is supported over and extends between said pulleys (52, 54).

15. A bottle-capping apparatus (18) as set forth in claim 14, wherein said endless belt (68) includes belt teeth (72).

16. A bottle-capping apparatus (18) as set forth in claim 15, wherein said pulleys (52, 54) include pulley teeth (56) and where said pulley teeth (56) intermesh with said belt teeth (72).

17. A bottle-capping apparatus (18) as set forth in claim 14, wherein said cap conveyor means (32) includes a gear assembly operatively connecting said pulleys (52, 54) to said turret (22).

18. A bottle-capping apparatus (18) as set forth in claim 17, wherein one of said pulleys (52, 54) is a drive pulley (52) and where said gear assembly includes a drive gear (58) supported for rotation coaxially adjacent said drive pulley (52).

19. A bottle-capping apparatus (18) as set forth in claim 18, wherein said gear assembly includes a clutch (60) engageably disposed between said drive pulley (52) and said drive gear (58).

20. A bottle-capping apparatus (18) as set forth in claim 19, wherein said clutch (60) is a ball/detent-type clutch.

21. A bottle-capping apparatus (18) as set forth in claim 18, wherein said gear assembly includes a lower idler gear (62) rotatably supported on said base plate (34) and operatively intermeshed with said drive gear (58).

22. A bottle-capping apparatus (18) as set forth in claim 21, wherein said gear assembly includes an upper idler gear (64) fixed coaxially to said lower idler gear (62).

23. A bottle-capping apparatus (18) as set forth in claim 22, and including a sun gear (66) supported on said turret (22) for rotation about said axis (A).

24. A bottle-capping apparatus (18) as set forth in claim 23, wherein said sun gear (66) is operatively intermeshed with said upper idler gear (64).

25. A bottle-capping apparatus (18) as set forth in claim 24, wherein said pulleys (52, 54), lower idler gear (62), upper idler gear (64) and sun gear (66) are alternately made of metal and plastic.

26. A bottle-cap delivery apparatus (10) for positioning bottle-caps (12) for pick-up by capping-heads (14) orbiting along a capping-head pitch circle (16) within a rotary bottle-capping machine (18), said apparatus (10) comprising:

a base plate (34);

cap conveyor means (32) supported on said base plate (34) for sequentially moving bottle-caps (12) along a semi-circular pick-up path;

said cap conveyor means (32) including an endless belt (68) with a belt inner surface (74) supported on said base plate (34) to orbit in place about an imaginary belt centroid (70);

a convex surface (78) disposed adjacent and parallel to said semi-circular pick-up path for guiding said belt (68) into a semi-circular curve adjacent and parallel to said semi-circular pick-up path;

characterized by said convex surface (78) disposed adjacent said belt inner surface (74) to displace said belt (68) and said semi-circular pick-up path outward and away from said belt centroid (70) to locate said belt centroid (70) and said belt (68) inside the pitch circle (16) of a rotary bottle-capping machine.

27. A bottle-cap delivery apparatus (10) as set forth in claim 26, wherein said cap conveyor means (32) includes at least two pulleys (52, 54) rotatably mounted adjacent said base plate (34).

28. A bottle-cap delivery apparatus (10) as set forth in claim 27, wherein said endless belt (68) is supported over and extends between said pulleys (52, 54).

29. A bottle-cap delivery apparatus (10) as set forth in claim 28, and including a guide block (76) disposed between said pulleys (52, 54).

30. A bottle-cap delivery apparatus (10) as set forth in claim 29, wherein said convex surface (78) is disposed on said guide block (76).

31. A bottle-cap delivery apparatus (10) as set forth in claim 30, wherein said cap conveyor means (32) includes a guide rail (90) disposed opposite said convex surface (78) and adjacent said semi-circular pick-up path.

32. A bottle-cap delivery apparatus (10) as set forth in claim 31, wherein said guide rail (90) includes a concave surface (92) spaced a constant distance across said semi-circular pick-up path from said guide block convex surface (78).

33. A bottle-cap delivery apparatus (10) as set forth in claim 31, wherein said cap conveyor means (32) includes a brake (94) pivotally mounted to said guide rail (90).

34. A bottle-cap delivery apparatus (10) as set forth in claim 33, wherein said brake (94) includes a trailing edge (98) and where said trailing edge (98) pivots out into said semi-circular pick-up path.

35. A bottle-cap delivery apparatus (10) as set forth in claim 34, wherein said brake (94) includes a compression spring (106) disposed between said guide rail (90) and said brake (94).

36. A bottle-cap delivery apparatus (10) as set forth in claim 28, wherein said endless belt (68) has a belt outer surface (75) and where a plurality of push-paddles (80) are spaced around and extend from said belt outer surface (75).

37. A bottle-cap delivery apparatus (10) as set forth in claim 36, wherein each said push-paddle (80) includes a cap-seat (84).

38. A bottle-cap delivery apparatus (10) as set forth in claim 36, wherein each said push-paddle (80) includes a tail section (86).

39. A bottle-cap delivery apparatus (10) as set forth in claim 28, including a cap feeder (40) supported on said base plate (34).

40. A bottle-cap delivery apparatus (10) as set forth in claim 39, wherein said cap feeder (40) includes a cap retainer (50) disposed adjacent said semi-circular pick-up path.

41. A bottle-cap delivery apparatus (10) as set forth in claim 40, wherein said cap feeder (40) includes a cap chute (42) intersecting said semi-circular pick-up path.

42. A bottle-cap delivery apparatus (10) as set forth in claim 41, wherein said cap chute (42) includes an exit (44) and where said exit (44) is disposed adjacent said cap retainer (50).

43. A bottle-cap delivery apparatus (10) as set forth in claim 41, wherein said cap feeder (40) includes a cap feed latch (46) retractably extending into said cap chute (42).

44. A bottle-cap delivery apparatus (10) as set forth in claim 43, wherein said cap feeder (40) includes a solenoid (48) operatively connected to said cap feed latch (46).

45. A bottle-cap delivery apparatus (10) as set forth in claim 44, wherein said solenoid (48) is a dual solenoid operatively connected to said cap feed latch (46).

* * * * *